US011806571B2

(12) United States Patent
Boruch

(10) Patent No.: US 11,806,571 B2
(45) Date of Patent: Nov. 7, 2023

(54) WEIGHTLIFTING GRIP

(71) Applicant: Ilya Boruch, Jamaica, NY (US)

(72) Inventor: Ilya Boruch, Jamaica, NY (US)

(73) Assignee: Grip Power Pads Corp., Jamaica, NY (US)

( * ) Notice: Subject to any disclaimer, the term of this patent is extended or adjusted under 35 U.S.C. 154(b) by 66 days.

(21) Appl. No.: 17/668,352

(22) Filed: Feb. 9, 2022

(65) Prior Publication Data

US 2023/0249025 A1 Aug. 10, 2023

(51) Int. Cl.
*A63B 21/00* (2006.01)
*A63B 21/065* (2006.01)

(52) U.S. Cl.
CPC ..... *A63B 21/4021* (2015.10); *A63B 21/065* (2013.01); *A63B 21/4035* (2015.10)

(58) Field of Classification Search
CPC .... A63B 21/4019–4021; A63B 21/065; A63B 21/4035; A63B 2244/09; A63B 71/14; A41D 13/08–082; A41D 13/085; A41D 19/01547; A41D 19/01558; A41D 19/01564
See application file for complete search history.

(56) References Cited

U.S. PATENT DOCUMENTS

| | | | | |
|---|---|---|---|---|
| 5,809,570 | A * | 9/1998 | Grover | A63B 21/4019 2/161.1 |
| 5,813,950 | A * | 9/1998 | Parker | A63B 21/4021 482/93 |
| 9,931,533 | B2 * | 4/2018 | Ingram | A63B 21/4021 |
| 10,098,393 | B2 * | 10/2018 | Parker | A63B 21/4035 |
| 10,946,234 | B2 * | 3/2021 | Starominsky | A41D 19/01547 |
| 11,642,588 | B2 * | 5/2023 | Parker | A63B 71/141 2/161.1 |
| 2011/0214220 | A1 * | 9/2011 | Parker | A61F 5/0118 2/161.1 |

* cited by examiner

*Primary Examiner* — Loan B Jimenez
*Assistant Examiner* — Kathleen M Fisk
(74) *Attorney, Agent, or Firm* — Axenfeld Law Group, LLC

(57) ABSTRACT

A grip assist with a wristband and a grip section affixed to the wristband. The wristband is configured as an anchor to wrap around a user's wrist. The grip section preferably includes a first layer extending from the wristband, toward a weight lifter's curled finger tips, then continuing along the inside of the fingers to a termination near the heel of the user's palm. Consequently, a held bar is trapped inside an encircling grip section. Additional layer(s) may also extend from the wristband generally in parallel with the first layer. The grip section can include at least one strategically placed interference element to augment grip endurance or security. An interference element may be sandwiched between the first and a second layer, or carried on either side of the first layer. Elements may be provided to enhance engaging the bar to prevent slippage, or to provide padding to the user's hands.

19 Claims, 9 Drawing Sheets

WEIGHTLIFTING GRIP

RELATED APPLICATIONS

This application claims the benefit under 35 U.S.C. 119(e) of the filing date of U.S. Provisional Patent Application Ser. No. 63/299,007, filed Jan. 13, 2022, for "WEIGHTLIFTING GRIP", the entire content of which is incorporated herein by reference.

BACKGROUND OF THE INVENTION

The Field of the Invention

The present invention relates to grip-assisting devices for weightlifting, and the like.

Related Art

U.S. Pat. No. 5,809,570 entitled "Wrist Harness Strap" issued Sep. 22, 1998, discloses a strap system that includes a gripping section positioned along the palm that extends from the wrist section of the strap. The palm section of the harness may be leather, suede, or rubberized cloth, but only contemplates a single material type. [5:55-67].

Similarly, wrist wraps and weightlifting straps currently on the market utilize cloth, leather, nylon, cotton, neoprene or rubber as the material for wrapping around the weightlifting bar and grip of the hands of the lifter. These straps and related weightlifting aids are intended to help distribute the weight between a lifter's hands and wrists, and help stop the weight bar from slipping out of the lifter's grip.

Many of the lifting straps and hand supports on the market are not ergonomic and therefore are uncomfortable cutting off circulation and providing uneven pressure on the lifter's hands and wrists; especially when attempting to lift heavy weight. Additionally, the gripping section of these straps often do not include sufficient gripping friction to prevent slippage of the bar from the weightlifter's hands.

Further, weightlifting straps and other weightlifting-grip aids on the market today are not able to withstand the wear and tear associated with weightlifting due to the lack of durability of the materials used to construct these weightlifting aids. Some of the materials may rip and tear, and can present a danger to the weight lifter due to unexpected failure of the material.

Therefore, there is a need for an improved weightlifting grip.

BRIEF SUMMARY

Described herein is a grip assisting device with a wristband and a grip section affixed to the wristband. The wristband is configured as an anchor to wrap around the wrist of a user. A wristband may be made reference to as a wrist-wrap. The gripping section is configured to wrap around a bar, such as an Olympic bar or pull-up bar, and to improve the user's grip security and/or endurance when holding the bar. A grip section may be made reference to as a bar-wrap.

The invention may be embodied as a grip assisting device that includes a wrist-wrap and a bar-wrap. A workable wrist-wrap encircles a human wrist to provide an anchor that resists separation of the wrist band from the wrist in a distal direction. A bar-wrap is typically affixed at its proximal end to the wrist-wrap. Such a grip assist helps a user to hold a bar during press- or pull-type movements. In general, the grip assist improves safety and/or grip endurance during weight lifting-type movements.

An exemplary bar-wrap includes a distally projecting length sized to circumscribe a portion of a weightlifting bar. Desirably, the bar-wrap includes a width sized in general agreement with the palm of a human hand. In certain cases, the distally projecting length of the bar-wrap may be sized to circumscribe less than the entire circumference of the bar. A distally projecting length of a workable bar-wrap can be sized to circumscribe a hand grip portion of a held bar without causing wrap overlap.

A currently preferred bar-wrap includes a transversely flexible membrane with a first area. The first area is configured for wrapping around a portion of the bar. In certain cases, the first area may have a generally uniform first thickness. An exemplary membrane may include, or be formed entirely from, a sheet or layer of leather. Sometimes, a bar-wrap may include a plurality of laminated layers and elements.

The preferred bar-wrap includes a second area having a second thickness that is larger than the first thickness. Therefore, the second area may be disposed as a stopper at a distal end of the membrane to resist pull out of a held bar-wrap during use of the apparatus in weightlifting. A stopper may include an element that is stacked on the membrane to provide the second thickness that is larger than a first thickness of the membrane. A stopper may be sandwiched between the membrane and a second layer, or may be an integral portion of a membrane having non-uniform thickness.

An exemplary bar-wrap may be configured and arranged to extend from an anchor on a palm-side of the wrist band to permit a user to wind the bar-wrap in a reversed direction from a finger-curl direction to dispose the first area between a held bar and the user's palm. Desirably, embodiments are configured to permit unaided installation of the bar-wrap portion into wrapped registration on the bar by the hand with which the grip assist device is used.

A workable bar-wrap may also include a bar-contact layer or element disposed on the bar-side of the membrane. Sometimes, a bar-wrap may include a friction-enhancing element to improve a user's grip on a held bar. For example, one or more teeth may be carried by the membrane, disposed to contact a held bar, and configured to augment a grip on the bar. An exemplary tooth includes a resilient element disposed between the membrane and a durable tooth cover. A cooperating bar-contact layer may be installed to sandwich a portion of the tooth cover against the membrane. The cooperating bar-contact layer can then include at least one aperture configured to provide an opening to permit direct contact between a portion of the tooth cover and the bar.

A workable bar-wrap may include additional or alternative functional elements. For one non-limiting example, a bar-wrap can include a spacer element disposed for installed registration at the heel of a wearer's palm. A friction enhancing element may include an elastomeric coating on the bar-side of the membrane. In certain cases, a bar-wrap may include a structurally reinforcing layer. One workable structurally reinforcing layer has a plan form sized in general agreement with the membrane. In one embodiment, a reinforcing layer is affixed to, and disposed on a bar-side of, the membrane. An exemplary workable reinforcing layer includes a mesh-reinforced thin sheet of rubber.

A currently preferred wrist-wrap includes an affixed layer of resilient padding disposed for contact with wrist skin at an anchor area. The padding of a preferred grip assisting device extends from the medial side of the wrist toward an opening at the lateral side of the wrist when the grip assisting device is in an installed position. Sometimes, a medially disposed portion of the padding may extend distally to terminate as a portion of a spacer disposed at the heel of the palm.

An exemplary wrist-wrap includes a leather belt disposed to circumscribe the user's wrist and any wrist padding that is present. A workable belt may extend in a circumferential direction to a return-loop. From there, the belt can extend in the reverse circumferential direction to double over itself, and can be secured in place with a hook-and-loop fastener.

BRIEF DESCRIPTION OF THE DRAWINGS

In the drawings, which illustrate what are currently regarded as the best modes for carrying out the invention.

DETAILED DESCRIPTION

Figure 1:
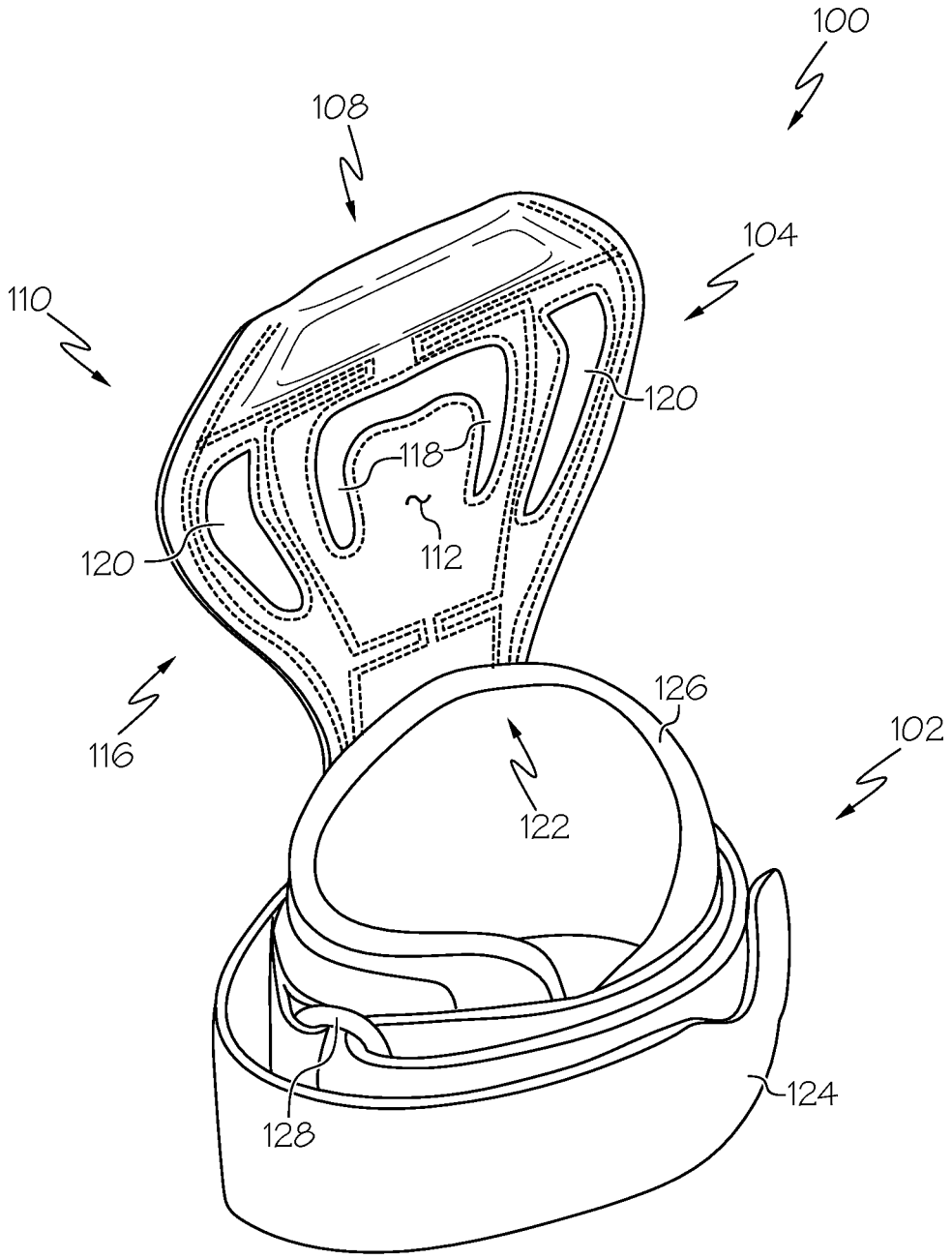
FIG. 1 is an isometric view of an exemplary grip assisting device according to certain principles of the invention.

FIG. 1 is an isometric view of a weightlifting grip assisting device according to certain principles of the invention and generally indicated at 100. As shown in FIG. 1, the device 100 includes a wrist-wrap section, generally 102, and a gripping section, generally 104, extending distally from the wrist-wrap section. The wrist-wrap section 102 is configured to wrap around the wrist of a weightlifter. The gripping section 104 is configured to wrap around a bar, such as an Olympic bar or pull-up bar. Consequently, the gripping section 104 may sometimes be made reference to as a bar-wrap 104.

Figure 8:
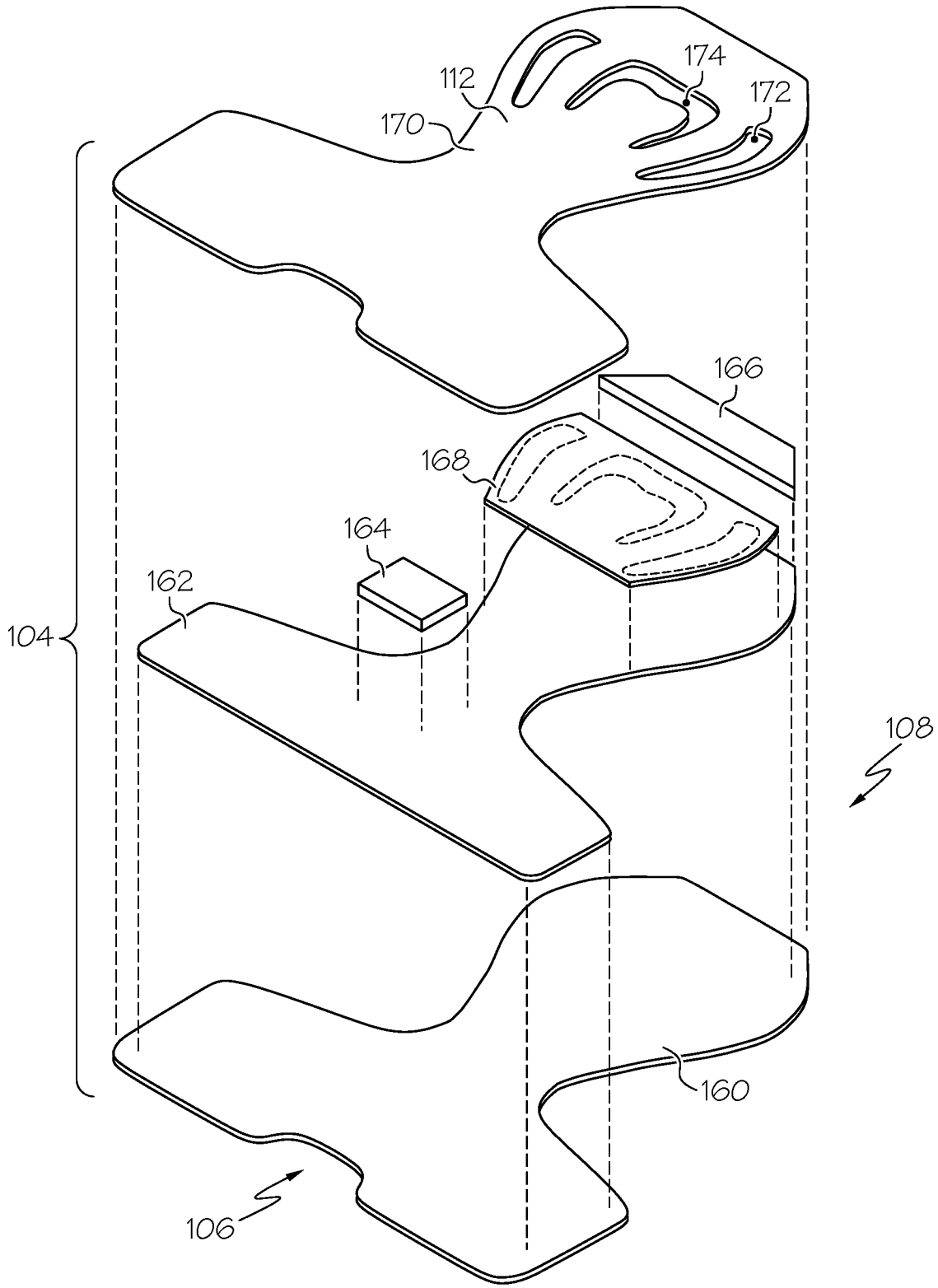
FIG. 8 is an exploded assembly view of an exemplary grip section.

The illustrated bar-wrap 104 has a somewhat paddle shape in plan view and extends from its proximal end 106 toward its distal end 108 (see FIG. 8). The proximal end 106 of the bar-wrap 104 can be fastened to the wrist-wrap section 102 by any suitable fastener, such as, but not necessarily limited to stitching, rivets, fasteners, glue, and/or any combination of the aforementioned.

Located toward the distal end 108 of the bar-wrap 104 is a stopper, generally indicated at 110. As will be discussed in more detail below, a stopper 110 contributes to holding a bar-wrap in registration around a weightlifting bar while lifting.

Figure 5:
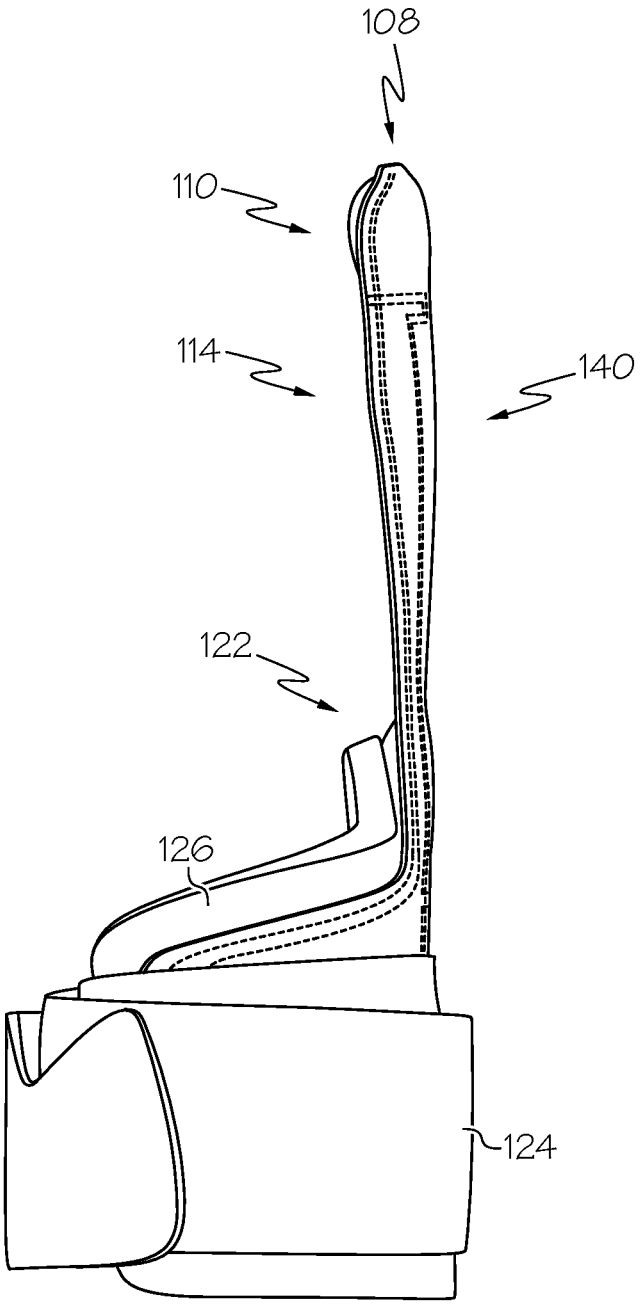
FIG. 5 is a right-side view thereof.
Figure 6:
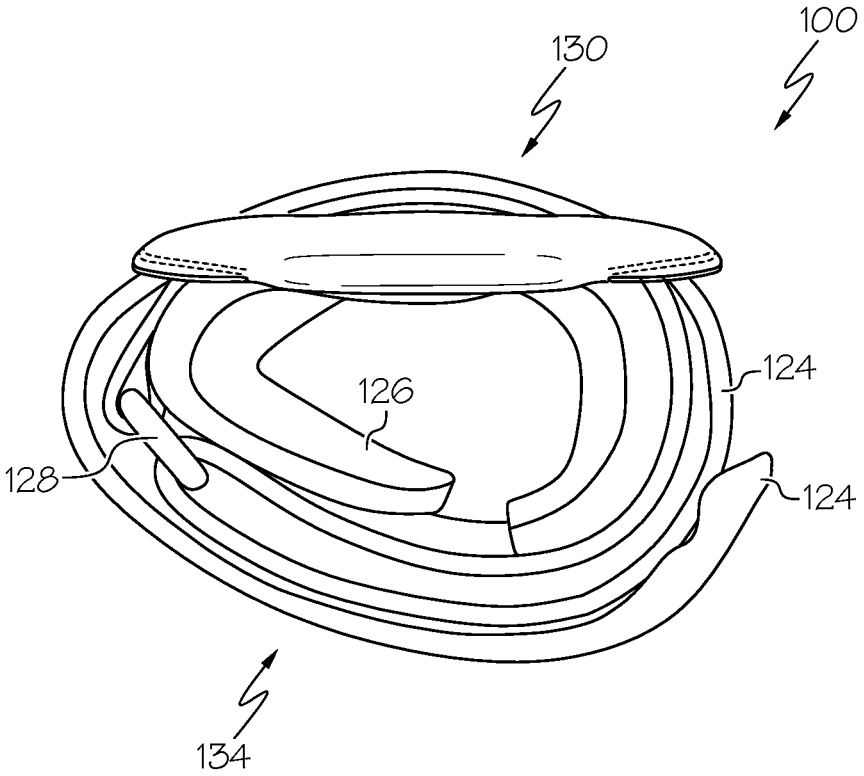
FIG. 6 is a top view thereof.
Figure 7:
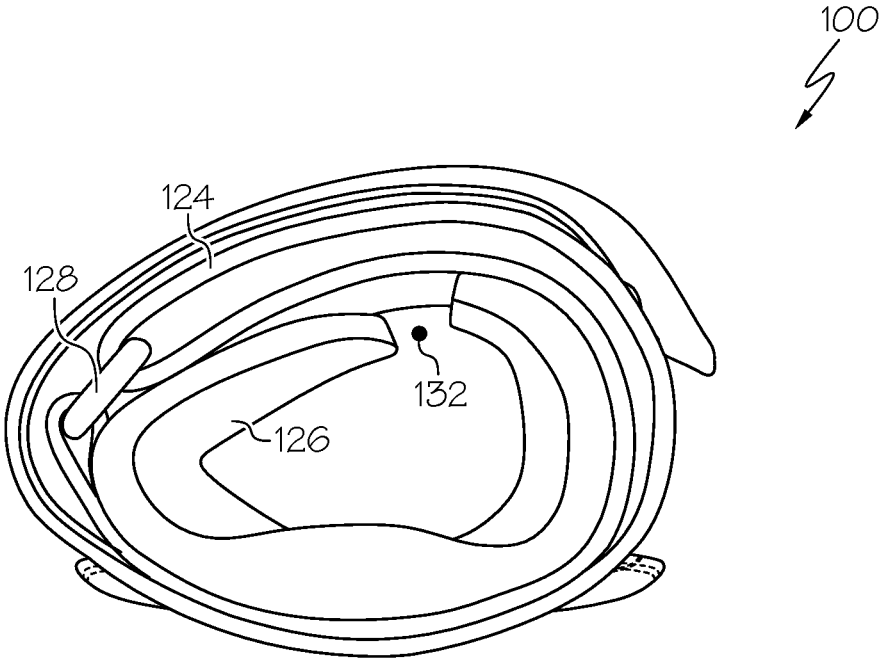
FIG. 7 is a bottom view thereof.

With particular reference to FIGS. 1 and 5, a bar-contacting surface 112 is disposed on the bar side, generally 114, of the bar-wrap portion 104 of grip assisting device 100. Surface 112 may sometimes carry one or more element to enhance a user's hand comfort and/or grip on a bar. For example, and with reference to FIG. 1, surface 112 may carry friction-enhancing structure, generally indicated at 116, to enhance friction on a bar. Workable friction-enhancing structure 116 includes the illustrated U-shaped "teeth" 118 and "horns" 120. Alternative friction-enhancing structure within contemplation includes a coating of an elastomeric material. Sometimes, a spacer element may be carried by surface 112 to project into an area disposed at a palm-heel area, generally indicated at 122.

A currently preferred wrist-wrap 102 includes a strap, or belt 124. Belt 124 is arranged to circumscribe the user's wrist and any wrist padding 126 that is present. A workable belt may extend in a circumferential direction to a return-loop, such as metal ring 128. From there, the belt 124 can extend in the reverse circumferential direction to double over itself, and can be secured in place with a hook-and-loop fastener.

Figure 2:
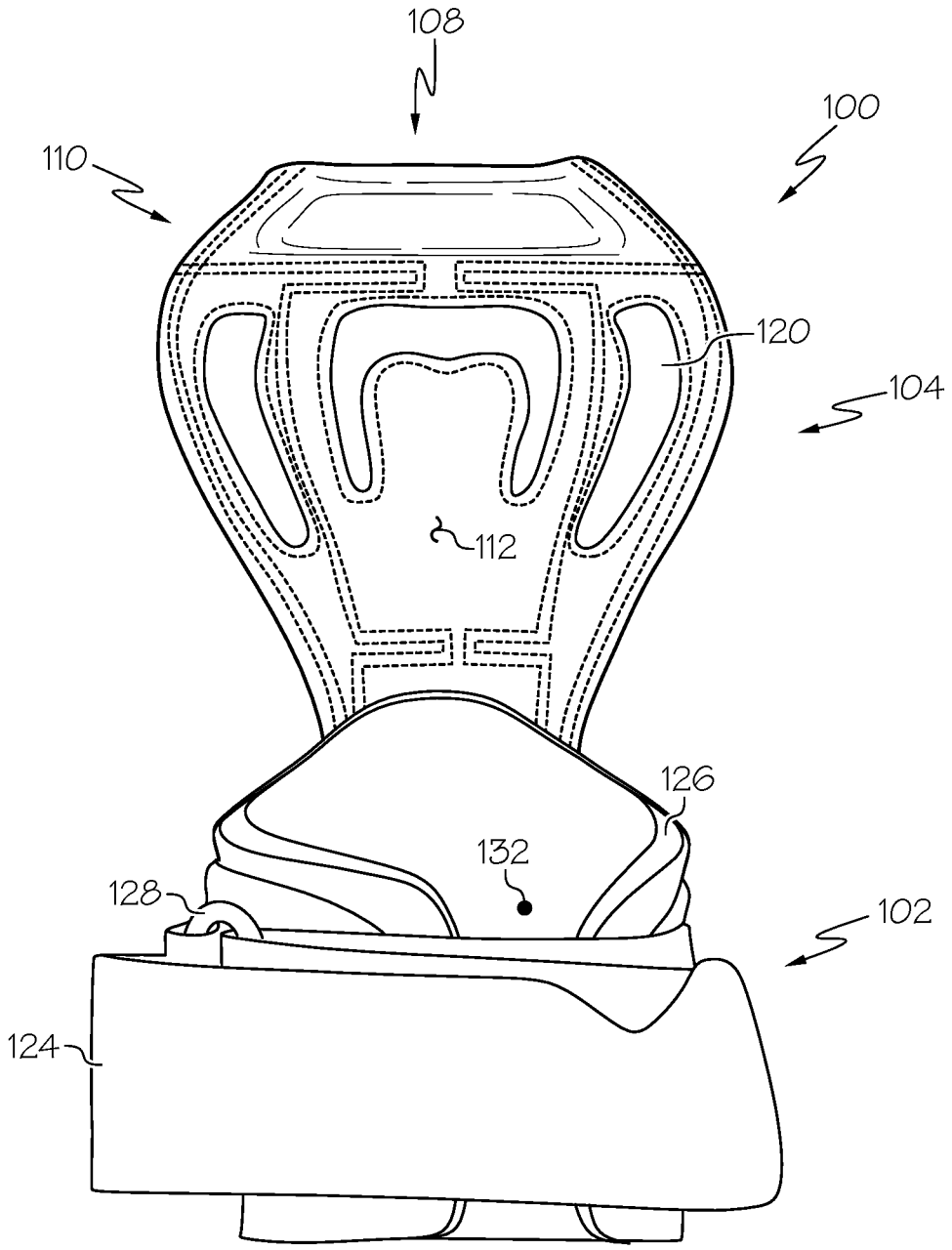
FIG. 2 is a front view thereof.
Figure 3:
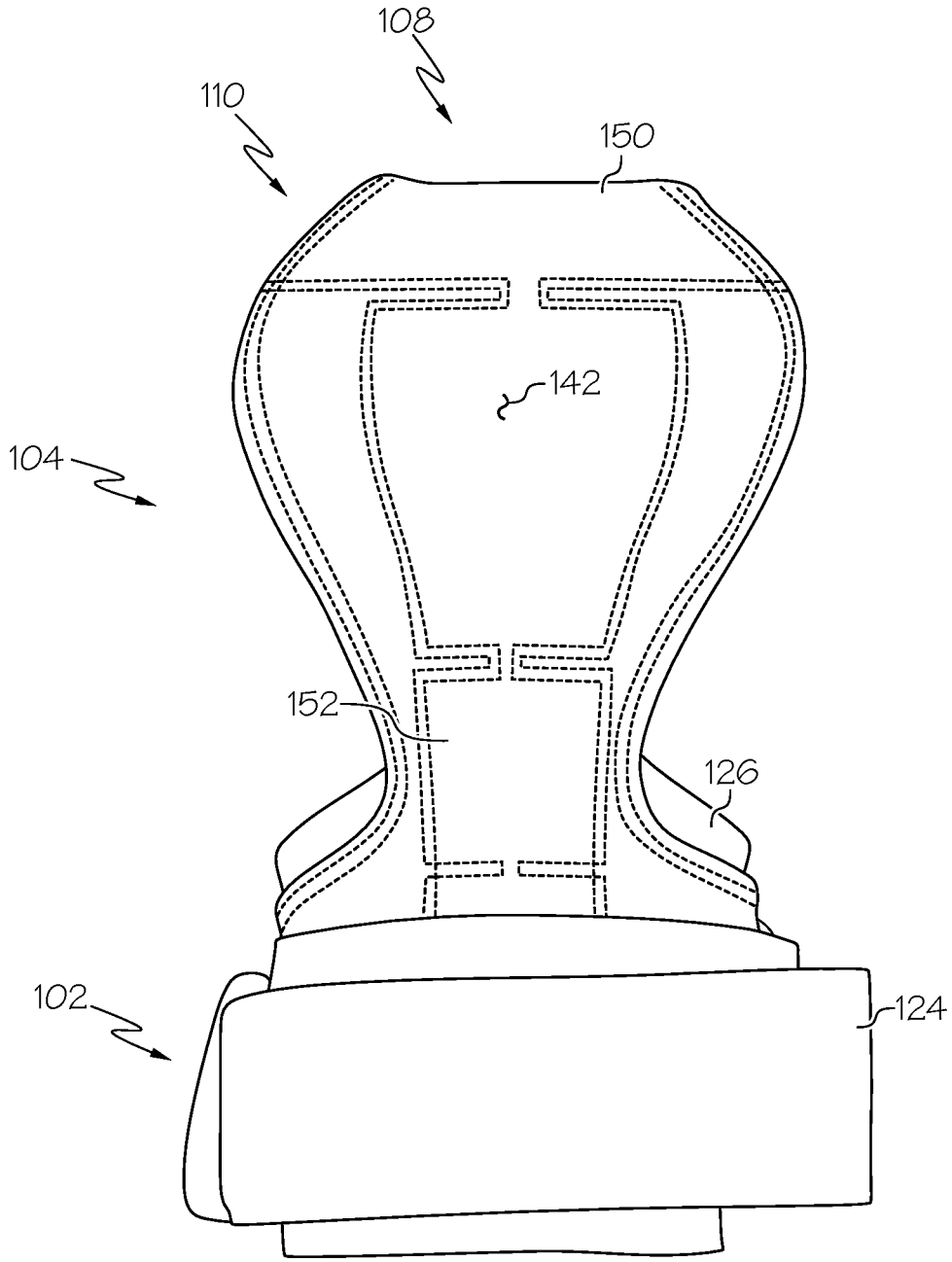
FIG. 3 is a rear view thereof.
Figure 4:
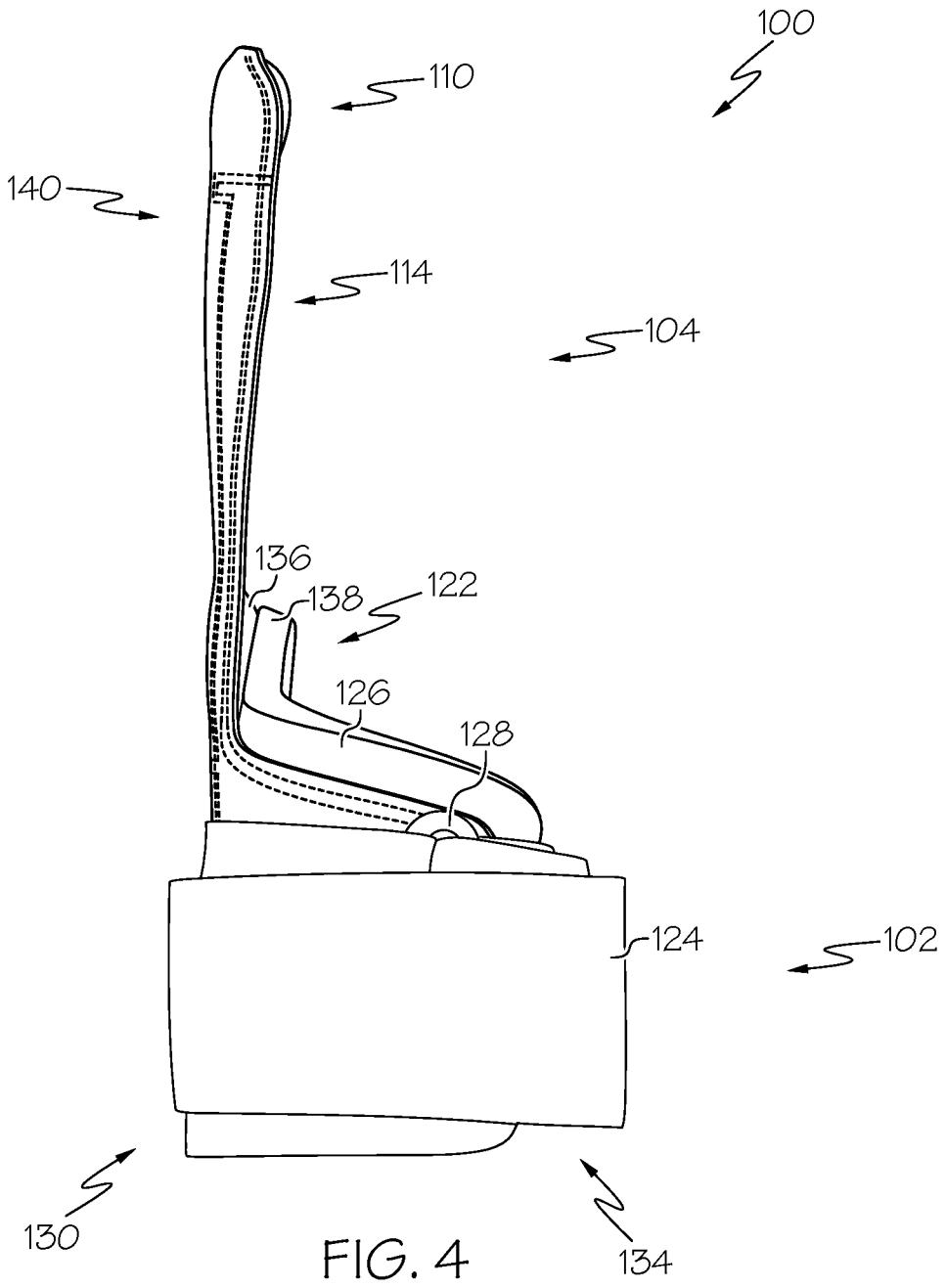
FIG. 4 is a left-side view thereof.

With particular reference now to FIGS. 2 through 4, illustrated wrist padding 126 extends from a medial side, generally 130, to a lateral opening 132 disposed on the lateral side, generally 134. As illustrated in FIG. 4, a bar-wrap 104 may carry a spacer element 136 for disposition at palm-heel area 122. Spacer 136 may cooperate with a distal edge spacer 138 that is provided by the wrist padding 126. Also, it may be seen that a finger/palm side, generally 140, of bar-wrap 104 is disposed on the opposite side of bar-wrap from bar-side 114.

With reference now to FIG. 3, an assortment of stitching, glue lines, or other fastening means are visible on surface 142 of finger/palm side 140. A variety of such fastening means will be readily apprehended by one of ordinary skill. Such fastening means may be used to form one or more compartment in which to hold a spacer element to increase a local thickness of bar-wrap 104. In an alternative arrangement, the various indicating double-dashed lines may approximate boundaries around certain spacing elements, and the elements may simply be affixed in some way to the bar-wrap 104.

For example, an optional compartment 150 may be provided to hold a spacing element that provides a portion of a stopper 110. Also, an optional compartment 152 may be provided to hold a spacing element for disposition of that element at palm-heel location 122.

FIG. 8 illustrates an exploded assembly view of a currently preferred bar-wrap 104. The illustrated bar-wrap 104 includes a plurality of laminated layers and cooperating elements. Membrane 160 may form a foundation layer for a bar-wrap 104. A workable membrane 160 may be embodied in a piece of leather. Certain membranes 160 may be substantially uniform in thickness. Other membranes 160 may inherently have different thicknesses in different locations. All other illustrated elements may be optional in alternative embodiments of a bar-wrap 104.

A reinforcement layer 162 is desirably included to enhance durability of a grip assist device 100. A preferred reinforcement layer 162 includes a thin sheet of rubber, or other elastomer. Illustrated layer 162 has a plan form area configured slightly smaller than the plan form area of layer 160 to facilitate assembly. A workable layer 162 includes a mesh reinforced sheet of rubber having a thickness of about 1 mm.

Spacing element 164 may be provided for disposition at palm-heel area 122. A spacer element 166 may be provided to thicken the membrane 160 at distal end 108, and form a portion of stopper 110. A tooth assembly 168 may sometimes be provided to enhance a friction grip on a held bar. Illustrated assembly 168 includes a plurality of elastomeric elements laminated to a cover sheet. A workable cover sheet for assembly 168 includes a piece of thin leather.

Top sheet 170 forms a portion of bar-contact surface 112. A workable top sheet 170 may be formed from a layer of leather. A plurality of apertures, 172, 174, may be provided in the top sheet 170 to provide access ports permitting contact between teeth 118 and horns 120 (in an assembly 168) and a held bar. The top sheet 170 may be stitched around apertures 172, 174, to augment retention of the friction-enhancing assembly 168.

Figure 9:
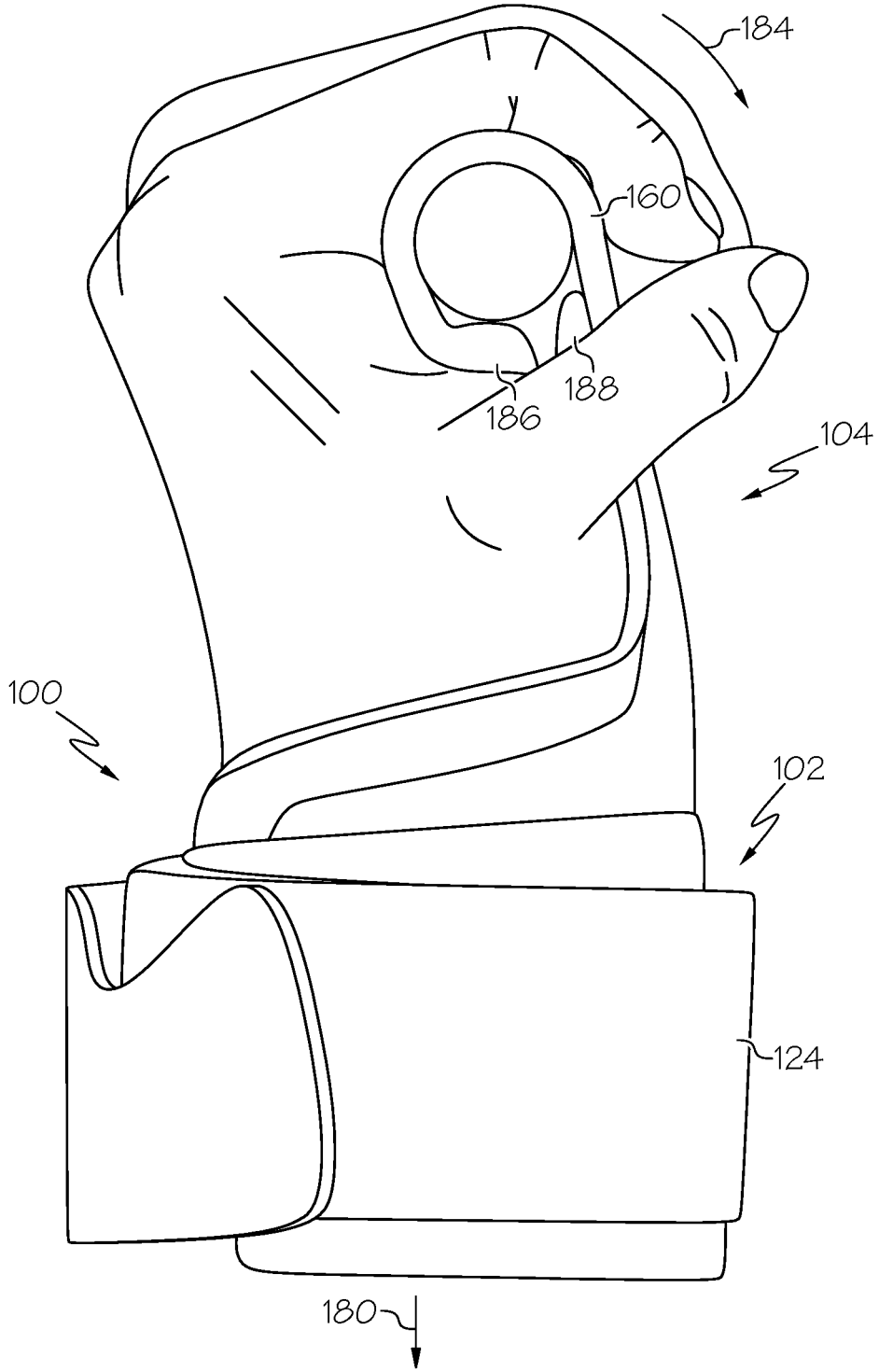
FIG. 9 is a side view, partially in cross-section, of the grip assisting device in FIG. 1 in use during a pull-up.
Figure 10:
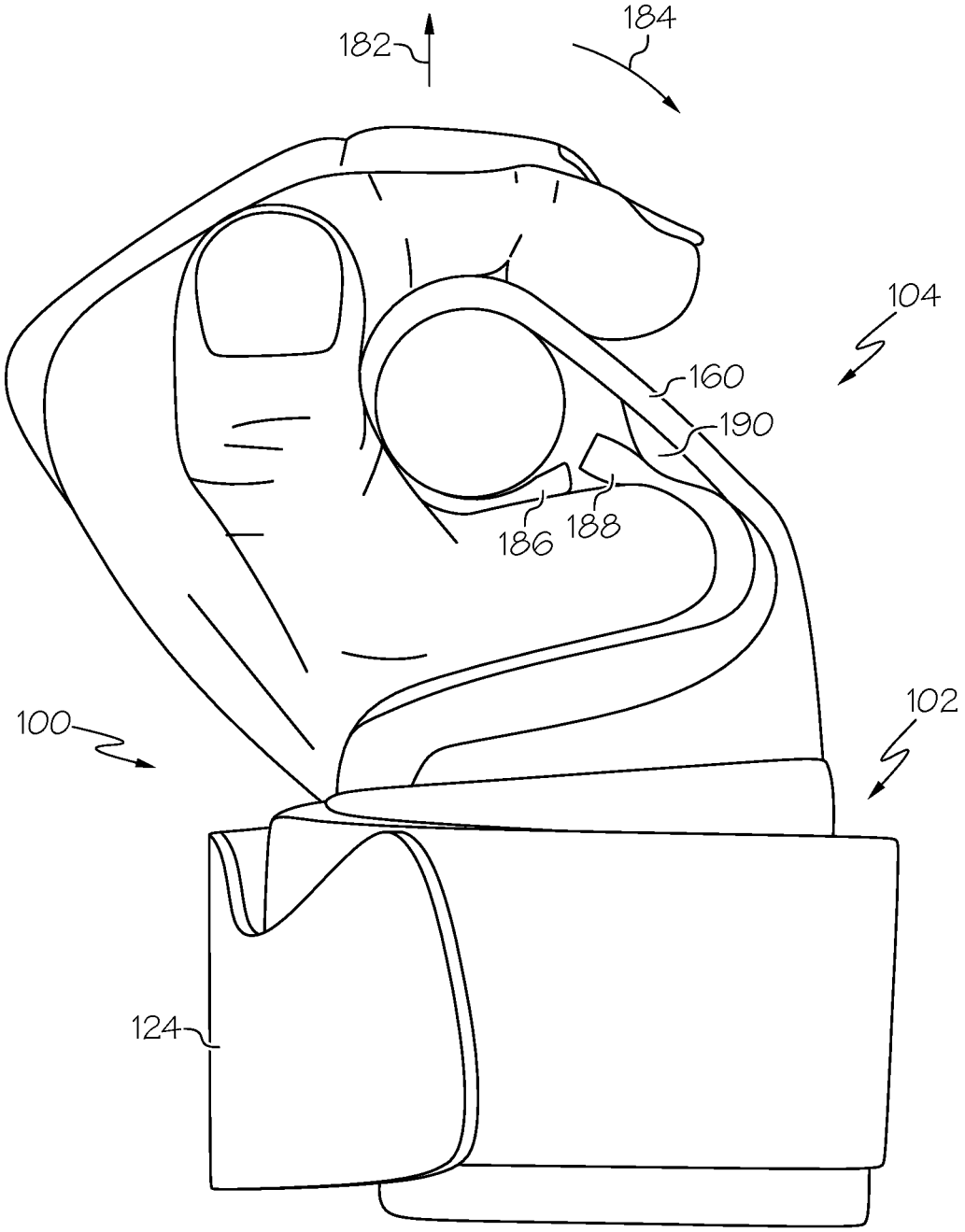
FIG. 10 is a side view, partially in cross-section, of the grip assisting device in FIG. 1 in use during a bench press lift.

A currently preferred use of a grip assisting device 100 is illustrated in FIGS. 9 and 10. FIG. 9 illustrates the case where a user is pulling on a bar in the direction indicated by arrow 180. This situation occurs during pull-ups, rowing, and the like. FIG. 10 illustrates the case where a user is pushing on a bar, as indicated by arrow 182. The latter case occurs during a bench press lift, dip, and the like. In either case, a bar-wrap 104 is desirably configured and arranged to extend from an anchor on a palm-side of the wrist-wrap 102 to permit a user to wind the membrane 160 in a reversed direction from finger-curl direction 184 to dispose a first area of bar-wrap 104 between a held bar and the user's palm/fingers.

An enlarged stopper element 186 forms a structural interference between the user's palm and the bar. That structural interference resists displacement of the membrane 160 in the finger-curl direction 184. That is, the bar would have to actually displace away from the palm or fingers to permit the relatively larger thickness of the stopper to move in a circumferential direction (e.g., finger-curl direction 184) around the bar. The weight applied to the bar would have to be overcome by the stopper 110 to make bar displacement away from the palm or fingers happen. Friction existing between the membrane 160 and the bar further reduces chance of membrane slip in finger-curl direction 184. Consequently, the device 100 substantially reduces the effort required from a user to apply a load to a bar over a sustained period of time.

As best illustrated in FIG. 10, a spacer element 188 (e.g., the edge of wrist padding 126), may be reinforced by bulge 190 (formed in-part, by spacer element 164 of bar-wrap 104) at palm-heel area 122.

While aspects of the invention have been described in particular with reference to certain illustrated embodiments, such is not intended to limit the scope of the invention. The present invention may be embodied in other specific forms without departing from its spirit or essential characteristics. The described embodiments are to be considered as illustrative and not restrictive. Obvious changes within the capability of one of ordinary skill are encompassed within the present invention. All changes which come within the meaning and range of equivalency of the claims are to be embraced within their scope.

What is claimed is:

1. An apparatus, comprising:

a wrist band configured to encircle a human wrist to resist separation of the wrist band from the wrist in a distal direction;

a bar-wrap affixed at a proximal wrap end to the wrist band, the bar-wrap comprising a distally projecting length sized to circumscribe a portion of a weightlifting bar, the bar-wrap comprising a width sized in general agreement with a palm of a human hand; wherein:

the bar-wrap comprises:

a transversely flexible membrane with a first area, the first area being configured for wrapping around the bar in a first direction reversed from a finger-curl direction; and a second area disposed as a stopper at a distal end of the membrane to resist pull out of the bar-wrap during use of the apparatus in weightlifting; wherein:

the bar-wrap further comprises a bar-contact layer disposed on a bar-side of the membrane and a plurality of teeth that are carried by the membrane, disposed to contact the bar, and configured to augment a grip on the bar;

at least one tooth of the plurality of teeth comprises a resilient element disposed between the membrane and a tooth cover;

a portion of the tooth cover is disposed between the bar-contact layer and the membrane; and the bar-contact layer comprises at least one aperture, the at least one aperture providing an opening to permit contact between the tooth cover and the bar.

2. The apparatus of claim 1, wherein:

the bar-wrap further comprises a reinforcing layer having a plan form sized in general agreement with the membrane, the reinforcing layer being affixed to, and disposed on the bar-side of, the membrane.

3. The apparatus of claim 2, wherein:

the reinforcing layer comprises a mesh-reinforced sheet of rubber.

4. The apparatus of claim 1, wherein:

the wrist band comprises an affixed layer of resilient padding disposed for contact with wrist skin, the padding extending from a medial side of the wrist toward an opening at a lateral side of the wrist when the apparatus is in an installed position.

5. The apparatus of claim 4, wherein:

a medially disposed portion of the padding extends distally to terminate as a portion of a spacer disposed at a heel of a wearer's palm.

6. The apparatus of claim 1, wherein:

the bar-wrap is configured and arranged to extend from an anchor on a palm-side of the wrist band to permit a user to wind the bar-wrap in the first direction to dispose the first area between the bar and the palm.

7. The apparatus of claim 1, wherein:

the apparatus is configured to permit unaided installation of the bar-wrap into wrapped registration on the bar by the hand on which the apparatus is worn.

8. The apparatus of claim 1, wherein:

a portion of the stopper is formed by an element stacked on the membrane to provide a structural interference, between the palm and the bar, to resist circumferential displacement of the membrane in the finger-curl direction.

9. The apparatus of claim 1, wherein:

the distally projecting length of the bar-wrap is sized to circumscribe less than an entire circumference of a grip area of the bar.

10. The apparatus of claim 1, wherein:

the distally projecting length of the bar-wrap is sized to circumscribe a circumference of the bar without overlap.

11. The apparatus of claim 1, wherein:

the bar-wrap further comprises a spacer element disposed for installed registration at a heel of a wearer's palm.

12. An apparatus, comprising:

a wrist-wrap configured to encircle a human wrist to provide an anchor that resists separation of the wrist-wrap from the wrist in a distal direction;

a bar-wrap affixed at its proximal end to the wrist-wrap, the bar-wrap comprising a distally projecting length sized to circumscribe a portion of a weightlifting bar, the bar-wrap comprising a width sized in general agreement with a palm of a human hand; wherein:

the bar-wrap comprises:

a transversely flexible membrane configured for wrapping around the bar to dispose a held portion of the bar-wrap between a user's hand and the bar;

a friction-enhancing assembly disposed on a bar-side of the membrane to enhance the user's grip on the bar;

a top sheet with a portion disposed between the friction-enhancing assembly and the bar, a plurality of apertures formed in the top sheet permitting contact between selected portions of the friction-enhancing assembly and the bar; and a stopper disposed at a distal end of the membrane, the stopper being configured and arranged to resist pull out of the bar during use of the apparatus in weightlifting.

13. The apparatus of claim 12, further comprising:

a reinforcing layer comprising a mesh-reinforced sheet of rubber and having a plan form sized in general agreement with the membrane, the reinforcing layer being affixed to, and disposed on the bar-side of, the membrane.

14. The apparatus of claim 13, wherein:

the plurality of apertures are configured to resemble elongate teeth and/or horns.

15. The apparatus of claim 12, wherein:

the plurality of apertures are configured to define at least three friction-enhancing structures of the friction-enhancing assembly disposed to contact the bars.

16. An apparatus, comprising:

a wrist-wrap configured to encircle a human wrist to provide an anchor that resists separation of the wrist-wrap from the wrist in a distal direction;

a bar-wrap affixed at its proximal end to the wrist-wrap, the bar-wrap comprising a distally projecting length sized to circumscribe a portion of a weightlifting bar, the bar-wrap comprising a width sized in general agreement with a palm of a human hand; wherein:

the bar-wrap comprises:

a transversely flexible membrane with a first area having a generally uniform first thickness, the first area being configured for wrapping around the bar;

a top sheet with a second area sized in general agreement with the first area;

a tooth assembly comprising a resilient element disposed between the membrane and the top sheet;

a plurality of apertures disposed in the top sheet to expose portions of the tooth assembly for contact between at least one tooth of the tooth assembly and the bar; and a stopper disposed at a distal end of the membrane, the stopper comprising a thickness greater than the first thickness to resist pull out of the bar-wrap during use of the apparatus in weightlifting.

17. The apparatus of claim 16, wherein:

the tooth assembly and the plurality of apertures define at least three friction-enhancing structures disposed to contact the bar, and configured to augment a grip on the bar.

18. The apparatus of claim 16, wherein:

the distally projecting length of the bar-wrap is sized to circumscribe a circumference of the bar without overlap.

19. The apparatus of claim 16, wherein:

the bar-wrap further comprises a spacer element disposed for installed registration at a heel of a wearer's palm.

* * * * *